United States Patent [19]

Reuter

[11] 4,390,057

[45] Jun. 28, 1983

[54] CURVED CONTINUOUS-CASTING MOLD AND METHOD OF REESTABLISHING THE INTERNAL DIMENSIONS THEREOF

[75] Inventor: Hans-Josef Reuter, Kürten-Biesfeld, Fed. Rep. of Germany

[73] Assignee: Mecan Arbed S.A., Luxembourg, Luxembourg

[21] Appl. No.: 259,093

[22] Filed: Apr. 30, 1981

Related U.S. Application Data

[63] Continuation-in-part of Ser. No. 215,153, Dec. 11, 1980, abandoned.

[30] Foreign Application Priority Data

Dec. 11, 1979 [LU] Luxembourg ..... 81982

[51] Int. Cl.[3] ..... B22D 11/00

[52] U.S. Cl. ..... 164/459; 164/418; 164/137; 164/342

[58] Field of Search ..... 164/418, 435, 436, 459, 164/491, 137, 339, 342; 249/82, 102, 155, 157, 158, 160

[56] References Cited

U.S. PATENT DOCUMENTS

| | | | |
|---|---|---|---|
| 2,835,940 | 5/1958 | Wieland | 164/435 |
| 3,581,804 | 6/1971 | Woltering | 164/137 |
| 3,603,377 | 9/1971 | Khimich et al. | 164/441 X |

FOREIGN PATENT DOCUMENTS

| | | | |
|---|---|---|---|
| 697208 | 11/1964 | Canada | 164/435 |
| 51-38234 | 3/1976 | Japan | 164/435 |
| 903420 | 8/1962 | United Kingdom | 164/435 |

*Primary Examiner*—Kuang Y. Lin

*Attorney, Agent, or Firm*—Karl F. Ross; Herbert Dubno

[57] ABSTRACT

A continuous casting mold for producing polygonal steel profiles by continuous casting by the curved-mold method, comprises individual plates defining the sides of the molds. The four plates are provided with recesses at their extremities which form abutting joint edges and the edges are held flush with one another by shims inserted between opposing surfaces of the plates at the corners thereof. One pair of plates is provided with radius or bevels so that the cross section of the interior of the mold is octogonal. According to the invention, moreover, the chamfered or bevelled surfaces and the surfaces between them are machined and a corresponding insertion shim is provided to insure that the edges are flush with one another.

5 Claims, 8 Drawing Figures

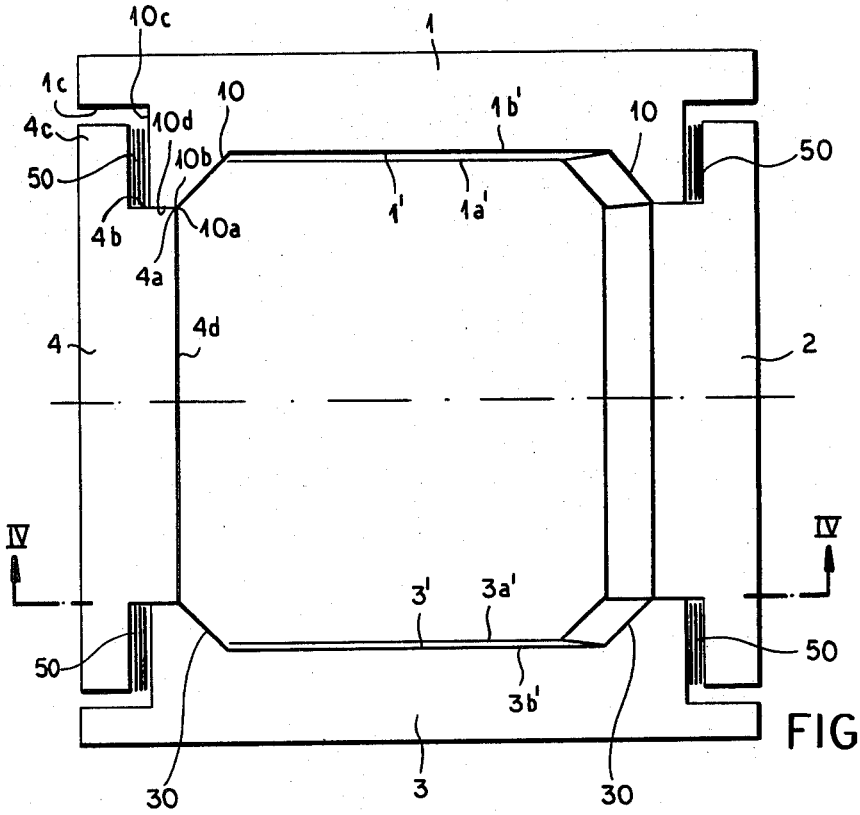
FIG.2
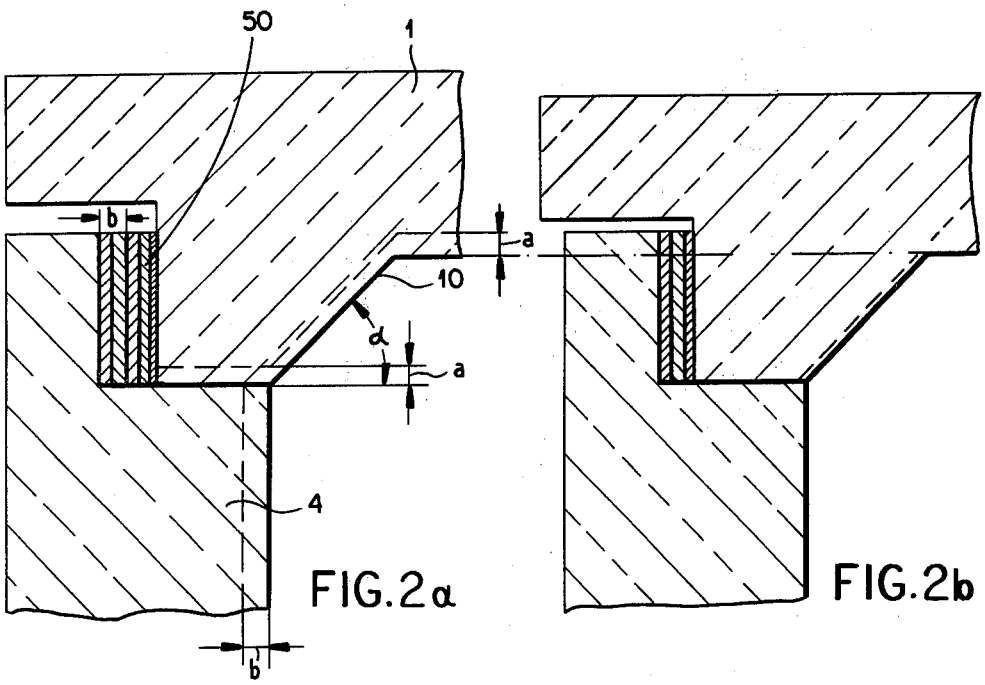
FIG.2a
FIG.2b

CURVED CONTINUOUS-CASTING MOLD AND METHOD OF REESTABLISHING THE INTERNAL DIMENSIONS THEREOF

CROSS-REFERENCE TO RELATED APPLICATION

This application is a continuation-in-part of copending application Ser. No. 215,153 filed Dec. 11, 1980, now abandoned.

FIELD OF THE INVENTION

The present invention relates to a curved continuous-casting mold for producing polygonal steel profiles and, more particularly, to a continuous-casting mold made up of a number of individual plates and defining a curved channel for the metal which hardens in the mold. The invention also relates to a method of reestablishing the internal profile or cross-section of the mold to its original dimensions following wear or other changes in these dimensions.

BACKGROUND OF THE INVENTION

In the continuous casting of steel bodies it is known to utilize curved continuous-casting molds (see the discussion at pages 707 ff. of The Making, Shaping and Treating of Steel, published by the United States Steel Company, Pittsburgh PA., ninth edition, copyright 1971).

Molds of this type, formed from plates, have been used in the curved continuous-casting process for the production of billets, blooms and other ingots of square, rectangular and generally polygonal profiles or cross-sections and impart a predetermined bend to the continuous ingot as it is cast and in the casting direction to avoid bending stresses in one relatively thin shell of hardened steel surrounding the soft inner core of the strand emerging from the mold.

In addition, it is desirable to impart to the channel a convergency in the direction of casting, i.e. a progressive reduction in the mold cross-section, corresponding to the shrinkage of the cooling cast strand to ensure continuous contact between the cooling strand and the inner wall of the mold over the entire length thereof. Furthermore, it is frequently desirable to so shape the corners on the mold or channel so that corner stresses on the cast body is minimized.

Because of wear, grooving and loss of conicity of the channel, the internal surfaces of the continuous casting mold must be periodically machined or refinished to restore the original surface finish and original dimensions of the mold channel.

With plate-formed molds, which have a complex geometry because of the aforedescribed criteria of bending and convergency, this machining is a serious problem because it is difficult to carry out and further because the material removal operation which refinishing involves leads to an increase in the mold cross-section and a corresponding increase in the cross-section of the continuous casting produced therein.

When it is desirable to retain the original dimensions of this cross-section, there have been only two alternatives heretofore. Either the wear is delayed so that refinishing or remachining is held in obeyance as long as possible, or one discards one or more mold plates or the entire mold.

To delay wear of the internal surfaces of the mold it is known to provide the internal surfaces with a coating of a wear resistant material such as zirconium oxide.

However, these techniques are extremely expensive and have proved to be economically undesirable in many instances.

Thus one had to select either a complex and expensive machining process, generally with increase in the cross section of the mold channel and hence in the continuous casting produced therein, or a process whereby the internal surfaces of the mold were protected against wear to the greatest degree possible at extremely high cost, or a system whereby all or part of the mold was discarded when wear occured. None of these alternatives have proved to be fully satisfactory.

OBJECTS OF THE INVENTION

It is the principal object of the present invention to provide an improved curved continuous casting mold whereby the aforementioned disadvantages are obviated.

Another object of this invention is to provide a continuous casting mold for use in curved-mold continuous casting whereby the mold can readily be restored to the original internal dimensions and cross-section with comparative ease and relatively low cost, while obviating the need to discard portions of the mold or to coat the latter with wear-resisting materials.

Yet another object of this invention is to provide an improved curved-type continuous casting mold which is free from the disadvantages of prior-art systems and can have a relatively complex geometry without concommitently increasing the cost of reestablishing the casting channel to its original dimensions and cross-sectional area.

Still further, it is an object of this invention to provide an improved method of reestablishing the original cross-section and internal dimensions of a curved-type continuous casting mold.

It is yet another object of the invention to provide an improved plate-type curved continuous casting mold affording the geometry criteria for effective curved-mold casting but which can be re-worked to establish the original casting channel cross-section and dimensions a number of times at relatively low cost.

SUMMARY OF THE INVENTION

These objects and others which will become apparent hereinafter are attained, in accordance with the present invention, in a curved continuous casting mold, especially for the casting of steel castings as described in the aforementioned publication, wherein the mold comprises four plates assembled together to define the mold channel which converges in the direction of casting and is curved in this direction as well.

According to the invention, the four individual plates are joined angularly and have meeting corners at which the plates are recessed so that they interfit and the junction edges are brought flush with one another at each corner by means of shims introduced into the recesses. Thus the junction edges are all at the same level at each corner. According to another central feature of the invention, the inner surfaces of two opposite plates are provided with chamfers on their edges at these corners so that the cross section formed by the chamfers or bevels and the mold walls between these bevels is octogonal.

The chamfers or bevels can be somewhat rounded if desired, so that the plates can be said to be radiused.

As will be apparent hereinafter, this mold enables reestablishment of the original cross-section at its original dimensions, upon wear or the like, by the insertion of shims between or the removal of shims from between a pair of juxtaposed surfaces of a joining plates which are not subject to wear.

In the assembled mold according to a first embodiment of the invention, the plates provided with the bevels lie parallel to the casting direction. In a second embodiment, the tangental plane at the top end of the plates provided with the bevels in the assembled mold lie transverse to the casting direction.

In either case, the plates with the tangential plane transverse to the direction of casting have a curvature corresponding to the bend desired in the casting during the curved-casting technique while the inner surfaces of the plates parallel to the casting direction are generally flat.

Again, in all of the cases described, the cross-section of the mold channel should converge from its inlet end to its outlet end, corresponding to a convergency of the planar surfaces toward one another and the gradual approach of the curved surfaces of the other plates toward one another as well.

According to yet another feature of the invention, the junction surfaces of the plates parallel to the casting direction have a corresponding curvature to the casting radius so that the separating joints of the assembled mold are curved in the desired sense.

The cross-section reduction of the mold in the casting direction is thus achieved by a corresponding formation of the abutment surfaces of the adjoining plates.

As has been indicated previously, the complex geometry of the plates can be established in large measure by appropriate shaping of the abutment surfaces of the individual plates. To retain the quality of the joints in the assembled mold, the abutment surfaces of the plates with the tangental plane transverse to the casting direction and free from the aforementioned bevels can be provided with a wear-resistant coating, e.g. of tungsten carbide, by any conventional technique.

The method of the present invention for reestablishing the original cross-section and cross-sectional dimensions of the mold described above comprises removing from the inner surfaces and from the abutment surfaces corresponding thereto, material to a thickness of a and removing from the bevels material to a thickness $a' = a \cdot \cos \alpha$, $\alpha$ being the bevel angle. The plates without bevels are machined to remove from the inner surfaces material to a thickness b and between the juxtaposed surfaces of joining plates to the mold, where the shims are disposed, additional shims equal in thickness to the dimension b are removed. The dimensions a and b may differ from one another.

As will be apparent, a multiple refinishing of the internal surfaces of the plates and practically automatic reestablishment of the mold cross-section to the original dimensions is possible and indeed this remachining operation can be carried as long as there is room defined by the shims between the individual plates to allow the material removal operations.

The system of the present invention thus markedly reduces the capital and maintenance costs of a continuous casting mold in accordance with the present invention.

BRIEF DESCRIPTION OF THE DRAWING

The above and other objects, features and advantages of the present invention will become more readily apparent from the following description, reference being made to the accompanying drawing in which:

FIG. 2 is an end view of a mold in accordance with a first embodiment of the present invention in which the plates carrying the bevels are those parallel to the casting direction;

FIGS. 2*a* and 2*b* are detailed cross-sections showing the resetting of the mold cavity to its original dimensions and shape;

SPECIFIC DESCRIPTION

Figure 1:
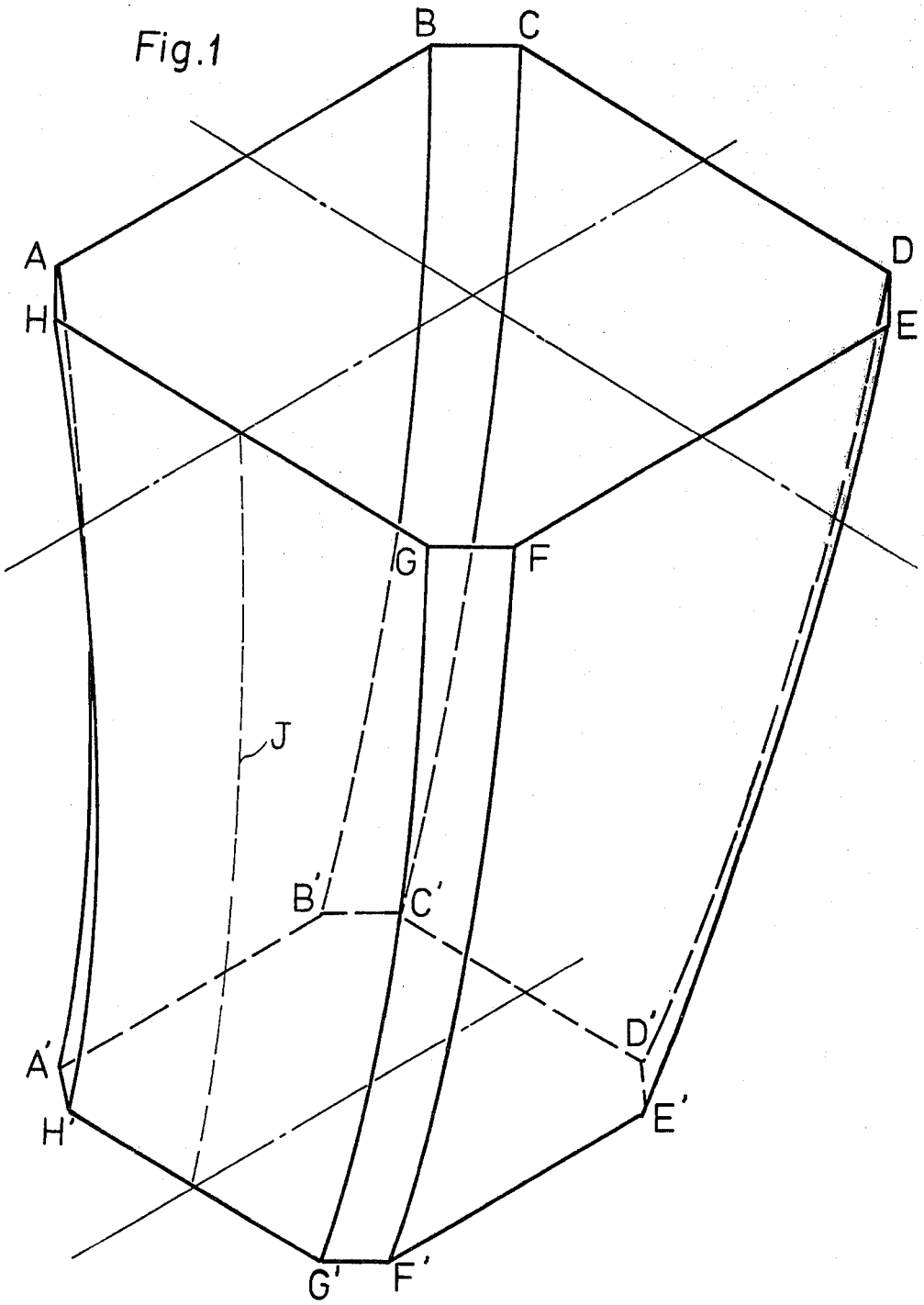
FIG. 1 is a perspective view of the internal profile of a plate mold for the curved continuous casting of steel castings in accordance with the present invention.

FIG. 1 shows the outline and relatively complex geometry of the internal profile of the plate mold of the present invention for the curved continuous casting of steel castings.

The upper end or mouth of the mold or mold channel forms a polygon whose vertices are marked A, B, C, D, E, F, G and H defining an octagon A–H whose cross-sectional area is greater than the cross-sectional area A'–H' at the opposite end of the mold channel, i.e. the downstream end thereof. As is shown by the broken line J, representing a generatrix, the surfaces A, H, G, F, F', G', H', A' and B, C, D, E, E', D', C', B' are curved with curvature of the generatrix J whereas the surfaces A, B, B' A' and E, F, F', E' are not curved and lie in planes extending generally parallel to the casting direction but converging toward one another.

It will be apparent from this figure and FIG. 2, for example, that the corner joints which form the separations between the four plates defining the mold running parallel to the casting direction are curved by virtue of having the corresponding abutment surfaces curved and that this is independent of whether the bevels forming the surfaces A, H, H', A' or B,C, B', C' or G, F, G', F' or D, E, E', D' are provided in the plates which are parallel to the casting direction or the other plates.

Figure 3:
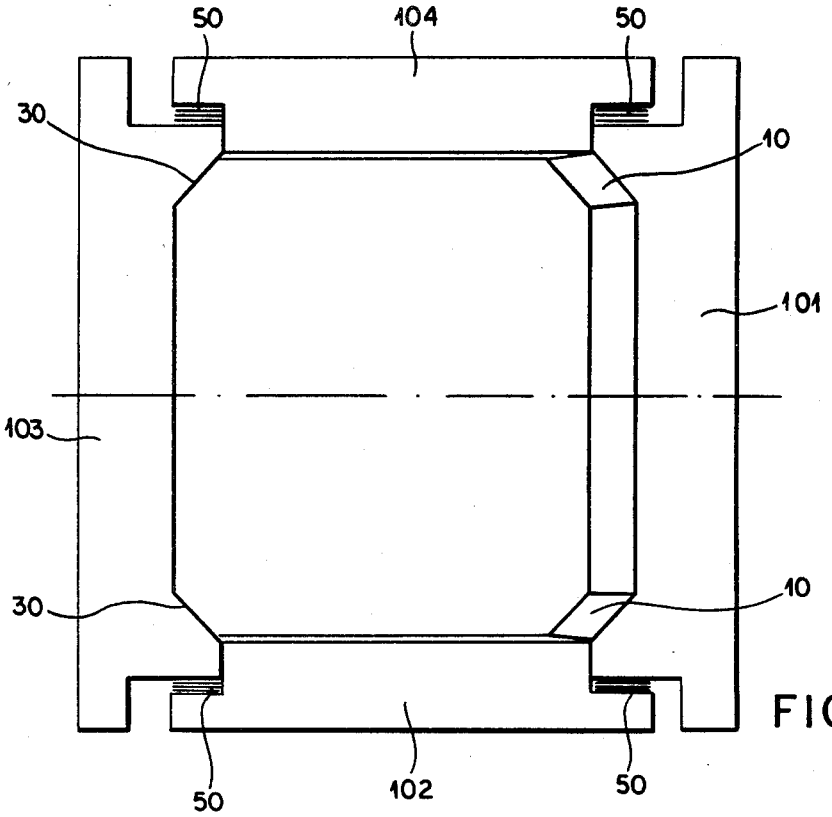
FIG. 3 is a view similar to FIG. 2 illustrating the embodiment of the invention in which the bevelled-carrying plates are those which are transverse to the casting direction.

FIGS. 2, 3 and the associated figures FIGS. 2*a*, 2*b* or FIGS. 3*a*, 3*b* show the machining process whereby the original cross-section and dimensions are established after wear.

The mold comprises, in the embodiment shown in FIG. 2, the four plates 1, 2, 3, 4, the plates 1 and 3 being provided with the bevels 10 and 30 while the plates 2 and 4 have the surfaces curved in accordance with the generatrix J. The inner surfaces 1' and 3' of the plates 1 and 3 are generally flat and extend in the casting direction while converging somewhat toward one another so that their lower edges 1*a'*, 3*a'* are closer together than their upper edges 1*b'*, 3*b'*.

At the upper left hand corner, the plates 1 and 4 are joined to form the joint 10*a* between an edge 10*b* of the plate 1 and an edge 4*a* of the plate 4. The joints 10*a* between the plates are curved to correspond to the curvature of the generatrix J as previously mentioned. This will be more readily apparent from FIG. 4, in which the edge 10*b* has been shown.

Figure 4:
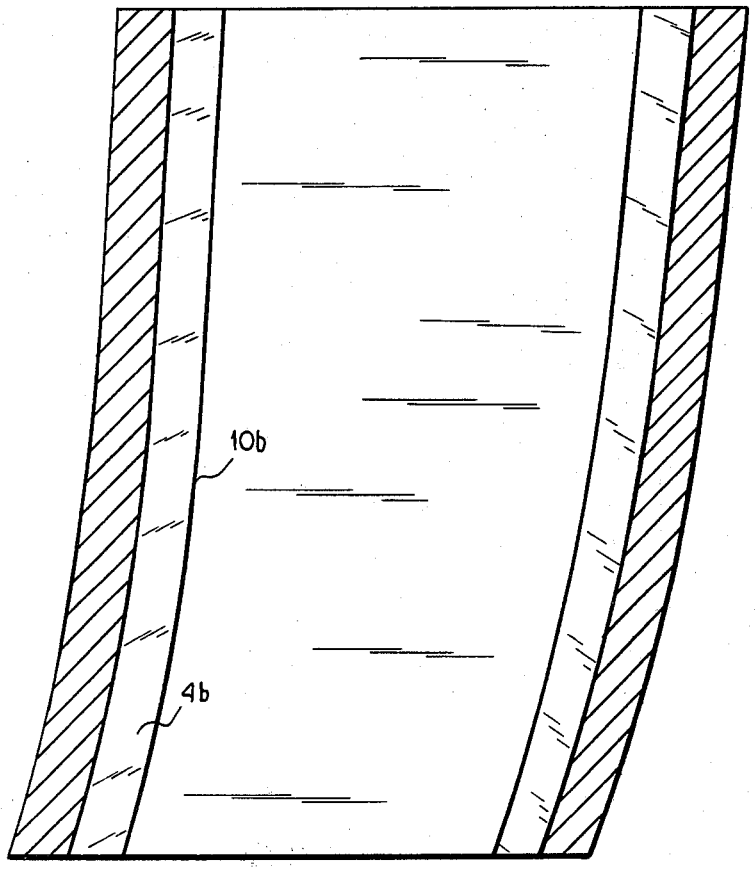
FIG. 4 is a cross-sectional view taken along the line IV—IV of FIG. 2.

The edges 4*a* lie at the inner ends of abutment surfaces 4*b* which are flat, are out of contact with molten metal and so they are not subject to wear, and run with similar curvature as shown for the surface with a corresponding numeral in FIG. 4.

The surface 4*b* terminates in a flange 4*c* perpendicular to this surface and confronting a flange surface 10*c* of the bevel plate 1. The confronting flange surfaces 4*c* and 10*c* likewise are parallel to one another and of the curvature of the generatrix J, i.e. the curvature of the inner surface 4*d* of the plate 4. Surface 10*c* is perpendicular to the other abutment surface 10*d* of plate 10. The surfaces 4*b* and 10*d* abut one another and the surfaces 4*c* and 10*c* define a gap which receives a stack of shims 50 best seen in FIGS. 2*a* and 2*b*.

The flange 4*c* and surface 4*b* form a recess in which the bevel-carrying member of plate 1 is received while plate 1 is likewise formed with a flange 1*c* defining with the surface 10*c* a recess accommodating the flange 4*c* and the shims 50.

The other corners are formed similarly.

The angle of the bevel 10 is represented at $\alpha$.

Referring now to FIGS. 2*a* and 2*b* it will be apparent that upon wear of the walls of the mold channel, a quantity of material to a thickness *a* is removed from the inner surface 1' of FIG. 1 and an equal thickness if removed from the abutment surface 10*d*. The thickness from the bevel 10 is equal to $a \times \cos \alpha$ where $\alpha$ is the bevel angle as shown, i.e. the angle included between the bevel and the abutment surface 10*d*.

To restore the original dimensions of the mold channel, a similar or different thickness can be removed from the inner surface 4*d* of plate 4 and shims corresponding in thickness to the dimension b is removed from the stack 50 thereby bringing the joint 10*a* back into flush relationship (FIG. 2*b*) and establishing the mold channel at its original cross section and dimensions.

Figure 3A:
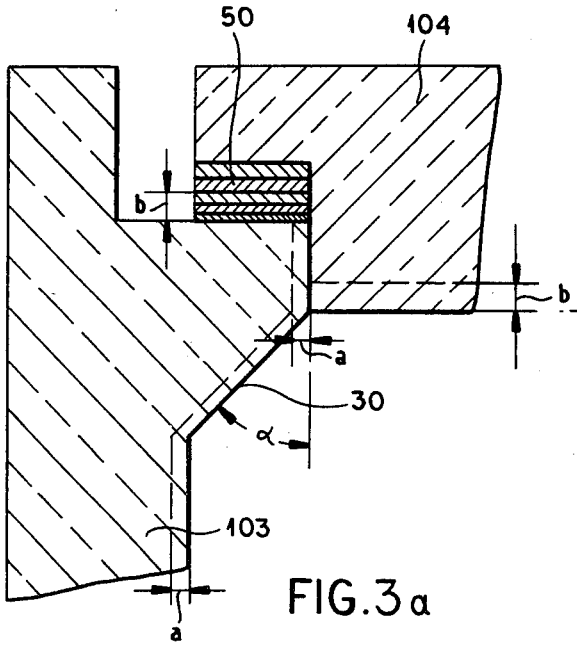
FIGS. 3*a* and 3*b* are views similar to FIGS. 2*a* and 2*b* but showing the resetting of the mold for this second embodiment.
Figure 3B:
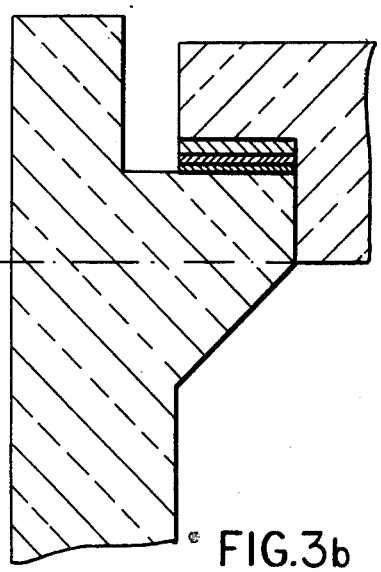

In the embodiment of FIGS. 3, 3*a* and 3*b*, the tangental plane of the bevel plates 101 and 103 extend transversely to the casting direction while the plates 102 and 104 are free from internal curvature and extend in the casting direction.

Although the abutment surfaces and bevels 10, 30 are reversed and the stacks 50 or shims rotated through 90° from the orientation shown in FIG. 2, the adjustment of the mold cavity to its original cross-section and dimension is accomplished in the same manner.

In both cases, surfaces such as the abutment surface 4*b* which are not to be machined for restoration of the mold channel, can be provided with wear-resistant coatings.

I claim:

1. A mold for curved-mold continuous casting comprising mold plates defining a mold channel curving and converging in a casting direction, each of said plates being formed with a recessed edge portion interfitting with a respective portion of an angularly adjoining plate at a corner of the channel wherein each pair of angularly adjoining plates have abutment surfaces in contact with one another over the length of the mold and defining joints between the plates of each pair, said each pair of angularly adjoining plates further having a first and a second pairs of confronting flange surfaces spaced from one another, said plates including a first pair of mutually opposite plates having substantially flat inner surfaces extending in said direction, and a second pair of opposite plates with curved inner surfaces, the plates of one of said first and second pairs being formed along their edges with internal bevels, said bevels and the inner surfaces of said plates imparting an octagonal cross-section to said channel, progressively reducing in the casting direction, a plurality of shims being disposed between the first pair of said confronting flange surfaces of each pair of angularly adjoining plates externally of said channel to position edges of the respective abutment sufaces flush with one another at the respective joint.

2. The mold defined in claim 1 wherein said bevels are provided on the plates of said first pair, said abutment surfaces being substantially flat while the first pair of said confronting flange surfaces being curved and converging in the casting direction.

3. The mold defined in said claim 1, wherein the plates of said second pair have said bevels, said abutment surfaces being curved correspondingly to the curvature of said channel, the first pair of said confronting flange surfaces of the plates being substantially flat.

4. The mold defined in claim 1, wherein the abutment surfaces of the plates which are not formed with said bevels are coated with a wear-resistant material.

5. A method of restoring an original configuration and dimension of a channel of a mold defined by inner surfaces of pairs of opposite plates having abutment surfaces adjoining each other at corners and confronting flange surfaces interposed by groups of shims, some of said plates having internal bevels, said method comprising the steps of:

removing material of a thickness "a" from the inner surfaces and abutment surfaces of the plates provided with said bevels and of a thickness $a \cdot \cos \alpha$ from said bevels, where $\alpha$ is the bevel angle;

removing material of a thickness "b" from the inner surfaces of the plates which are not provided with said bevels; and withdrawing shims at each corner with a total thickness "b", where "b" can be the same or different from "a"; and bringing the plates into mutual contact until the respective abutment surfaces flush with one another at a respective joint.

* * * * *